United States Patent [19]

Dominick

[11] Patent Number: 4,572,744

[45] Date of Patent: Feb. 25, 1986

[54] PROCESS FOR CLEANING THE INTERIOR OF A CONDUIT HAVING BENDS

[75] Inventor: George C. Dominick, Kingwood, Tex.

[73] Assignee: Union Carbide Corporation, Danbury, Conn.

[21] Appl. No.: 422,080

[22] Filed: Sep. 23, 1982

[51] Int. Cl.[4] ..... B08B 9/04

[52] U.S. Cl. ..... 134/7; 134/8; 134/22.12

[58] Field of Search ..... 134/7, 8, 22.11, 22.12; 15/104.05, 104.06 A, 104.06 R; 51/411

[56] References Cited

U.S. PATENT DOCUMENTS

| | | | |
|---|---|---|---|
| 335,608 | 2/1886 | Messer | 15/104.05 |
| 2,739,424 | 3/1956 | Fritze | 51/319 |
| 2,745,231 | 5/1956 | Prince | 51/317 |
| 2,884,745 | 5/1959 | Fritze et al. | 51/411 X |
| 3,523,826 | 8/1970 | Lissant | 134/22.12 X |
| 4,050,384 | 9/1977 | Chapman | 15/104.05 X |
| 4,297,147 | 10/1981 | Nunciato et al. | 134/7 |

*Primary Examiner*—Jay H. Woo
*Assistant Examiner*—Joye L. Woodard
*Attorney, Agent, or Firm*—Alvin H. Fritschler

[57] ABSTRACT

An improved process for cleaning the interior of a conduit having a series of straight sections and bends. The process includes passing a transit line having a multiplicity of flow divertors positioned at intervals along the length thereof through said conduit. By injecting a propelling gas stream having cleaning particles entrained therein, the multiplicity of flow divertors serve to enhance the in-situ cleaning action of the particles while the propelling gas stream serves to activate the flow divertors and cause the transit line to move along the straight sections and around the bends of the conduit.

24 Claims, 2 Drawing Figures

PROCESS FOR CLEANING THE INTERIOR OF A CONDUIT HAVING BENDS

BACKGROUND OF THE INVENTION

1. Field of The Invention

The invention relates to the passage of a transit line through a conduit containing straight sections and bends. More particularly, it relates to the overcoming of the capstan effect that impedes the passage of the line through such a conduit.

2. Description of the Prior Art

The Sandjet process is a well known and successful process for the in-situ cleaning of the interior surfaces of conduits used for the transport and/or processing of fluids, solids or a mixture thereof. The conduits thus cleaned include fired heater tubes used in hydrocarbon or chemical processing, pipelines, heat exchange tubes and the like. In the practice of the Sandjet process for such in-situ cleaning operations, cleaning particles are entrained in a propelling fluid stream and are introduced into the conduit to be cleaned at a velocity sufficient to effect the desired cleaning action.

In furnace tube applications, the Sandjet process is used to decoke and clean furnace tubes. This application of the process is described in the Nunciato et al patent U.S. Pat. No. 4,297,147, entitled "METHOD FOR DECOKING FIRED HEATER TUBES". As is well known to those skilled in the art and as disclosed and illustrated in said patent, furnace tubes generally comprise a series of straight sections and return bends. In some instances, the tubes will have an equivalent continuous helical tube configuration. By the use of steel shot or other suitable cleaning materials, the Sandjet process can achieve a desirable decoking action without undue abrasion of the straight sections or of the return bends of such furnace tubes. The Sandjet process provides significant advantages over the known alternative decoking approaches, such as turbining, hydroblasting and steam-air decoking, as is noted in the patent. There is also a growing appreciation in the art of the energy savings that can be derived when furnace tubes have been decoked by means of the Sandjet process as compared with the results obtainable by the most frequently used alternative approach, i.e. steam-air decoking.

It is recognized, however, that improvements in the Sandjet process are required in order to extend the capability of the process for the cleaning of certain furnace tubes having difficult-to-remove coke deposits on the interior surfaces thereof. Such deposits, as present in certain high heat duty or thermally abused furnace applications, are not removed to the extent desired by the Sandjet process using steel shot as the cleaning material. lt has also been found that such deposits are also generally resistant even to angular, abrasive cleaning materials, such as flint. The use of such abrasive materials are not generally desirable for use in furnace tube decoking applications in any event, as such materials cause severe erosion of the bends of furnace tubes, even in those instances in which difficult-to-remove deposits may not be satisfactorily removed from the straight sections of the tubes. The improvements needed in the art should enable the Sandjet process to be employed with enhanced reliability in the decoking of difficult-to-remove deposits, out without resulting in an unacceptable level of abrasion of the tubes, particularly the bends of said tubes.

One approach to the development of improvements enhancing the Sandjet process resides in the use of new cleaning agents to achieve an advantageous balance of desired cleaning action and undesired aorasive action. Some such agents would have an improved cleaning action over that achieved by steel shot, while avoiding tne abrasive action of materials such as flint. Other cleaning agents might also have an enhanced cleaning effectiveness, particularly with respect to difficult-to-remove deposits, where such effectiveness is of primary concern and where the furnace tube system can tolerate the higher level of erosion that may accompany the ability of the agents to effectively remove deposits that are resistant to removal when other, less abrasive cleaning materials are employed.

It may, nevertheless, oe desirable to use steel shot or relatively mild abrasive materials in particular applications of the Sandjet process for furnace tube decoking or other conduit cleaning operations. It will also be appreciated oy those skilled in the art that, for certain decoking or other cleaning operations, further improvement in the Sandjet process may be desirable over and above that achievable by enhanced cleaning agents alone. In such instances, other techniques for enhancing the effectiveness of the Sandjet process are desired to meet the requirements of particular commercial applications. The use of a flow diverter to divert the cleaning particles entrained in a propelling gas stream toward the inside surfaces of the furnace tube or other conduit to be cleaned has been considered for such a purpose.

The use of a flow diverter to improve the cleaning of the inside of a pipe is known in the art. The Prince patent, U.S. Pat. No. 2,745,231, for example, teaches the insertion into a pipe of a generally spherical, rigid object having a diameter slightly less than the inside diameter of the clean pipe. The object almost blocks the bore, but is nevertheless free to pass through it upon being subjected to hydraulic pressure. When the object, such as a solid or hollow steel ball, is in the pipe and an abrasive-laden liquid is being forced through the pipe, the pumping pressure applied to the abrasive-laden liquid, and the action of the object in directing the liquid into the annular space between the object and the surface of the pipe, create an abrasive jet against the pipe to remove scale deposited thereon. Similarly, the Messer patent, U.S. Pat. No. 335,608, shows the use of a ball placed inside a pipe and tethered by means of a cord, to force a stream of water to flow around its periphery to strike and dislodge sediment deposited on the surface of the pipe. The Fritze patent, U.S. Pat. No. 2,739,424, shows the use of a conically shaped deflector to deflect abrasive material against the inner surfaces of a pipe being sandblasted. The use of such a flow diverter in the practice of the Sandjet process, for furnace tube decoking or other cleaning applications, would be beneficial to the in-situ cleaning action being carried out within the tube or other conduit. Thus, a flow diverter, such as a cone or sphere, placed in a propelling gas stream having cleaning particles entrained therein, would divert the particles toward the pipe or conduit wall, increasing the angle of impact and the number of impacts of the cleaning particles with the inside wall surfaces. The velocity of the particles and of the propelling gas stream would also be increased in the vicinity of the flow diverter. The use of a flow diverter in the practice of the Sandjet process would thus be advantageous in certain applications, enhancing the effectiveness of the cleaning action and perhaps enabling steel shot or mild abrasive cleaning agents to approach the cleaning effectiveness of flint, grit or other abrasive materials, but without the relatively severe bend erosion commonly associated with such more agressive, abrasive cleaning materials.

In the decoking of furnace tubes having many straight sections and return bends, it has not heretofore been possible to employ a flow diverter with sufficient success to justify its incorporation in the Sandjet process on a practical commercial basis. In the absence of a tether or other restraining or pulling means, the free-flowing diverter may become hung-up or jammed in the tubes being cleaned in a position such as to make it difficult to dislodge and remove the diverter from the tubes. In such a circumstance, costly and time consuming efforts may be required in order to remove the diverter from the tubes, even to the extent of requiring that the tubes be cut open in order to recover the flow diverter and open up the interior surface of the tubes for further cleaning before re-use. If the diverter does not become jammed, it is found to pass through the tubes at such rapid, uncontrollable speed that it is ineffective for its intended cleaning enhancement purposes. The use of a tether or connecting line is essential, therefore, to avoid such undesirable circumstances that may render the use of the diverter futile or even totally destroy the benefits to be achieved by the use of the in-situ Sandjet process in the first instance. It has been found, however, that a tethered flow diverter cannot be used in the practice of the Sandjet process for the decoking and cleaning of furnace tubes having a series of five or more straight sections and return bends as occurs in typical furnace tube bundles. As the line or other tether is wrapped about return bend sections, and extends along straight sections, and back around the next succeeding return bend and continues in the opposite direction in the next succeeding straight section, throughout a series of many straight sections and return bends, a capstan effect is encountered that effectively precludes the passage of the diverter through the tubes. This effect is due to the very appreciable frictional forces encountered in attempting to move a line through a flow path having such a back and forth movement through a series of many straight sections and return bends. It will be appreciated that such forces pertain regardless of whether the line and the flow diverter attached thereto are being pulled against a flow of cleaning material and a propelling gas stream, or are attempted to be moved by such gas stream against the restraining frictional force of a tether. In either case, it has been found that the frictional forces encountered due to the capstan effect are sufficiently great as to effectively preclude the use of a tethered flow diverter in practical commercial operations. Thus, the very great forces involved may exceed the strength of the line or the capacity of the propulsion means employed to move the line through the tubes, or require the use of pressures exceeding the strength of the tubes themselves, or may otherwise render the use of a tethered diverter impractical in Sandjet process operations or in other applications in which it is desired to pass a tether, cable or other transit line through the interior of a conduit having a series of straight sections and bends. The overcoming of the capstan effect would be useful, therefore, not only to enable a flow diverter to be used in the practice of the Sandjet process for furnace tube decoking, but more broadly to enable any transit line to be passed through a series of straight sections and bends without the overwhelming deterrent created by the capstan effect, regardless of the particular purpose for which the line may be advantageously passed in innumerable practical, commercial activities.

It is an object of the invention, therefore, to provide a process for overcoming the capstan effect encountered in passing a line through such a conduit, thus facilitating the passage of said line through a conduit having a series of straight sections and bends.

It is another object of the invention to enhance the Sandjet process for the in-situ cleaning of conduits having such straight sections and bends.

It is a further object of the invention to provide a process in which the beneficial effects of a flow diverter can be utilized in the practice of the Sandjet process for the decoking and cleaning of furnace tubes.

With these and other objects in mind, the invention is hereinafter described in detail, the novel features thereof being particularly pointed out in the appended claims.

SUMMARY OF THE INVENTION

The positioning of a multiplicity of propulsive bodies along the length of a transit line serves effectively to overcome the capstan effect that otherwise impedes the passage of the line through the interior of a conduit having a series of straight sections and bends. The propulsive bodies may comprise flow diverters propelled by a pressurized fluid, as by the propelling gas stream having cleaning materials entrained therein employed in the Sandjet process used for the decoking and cleaning of furnace tubes. The propulsive bodies may also comprise propulsive jets, motor-operated bodies or other such bodies used to move a line through such a conduit for a wide variety of operational or inspection purposes.

BRIEF DESCRIPTION OF THE DRAWINGS

The invention is further described herein with reference to the accompanying drawings in which.

DETAILED DESCRIPTION OF THE INVENTION

Figure 1:
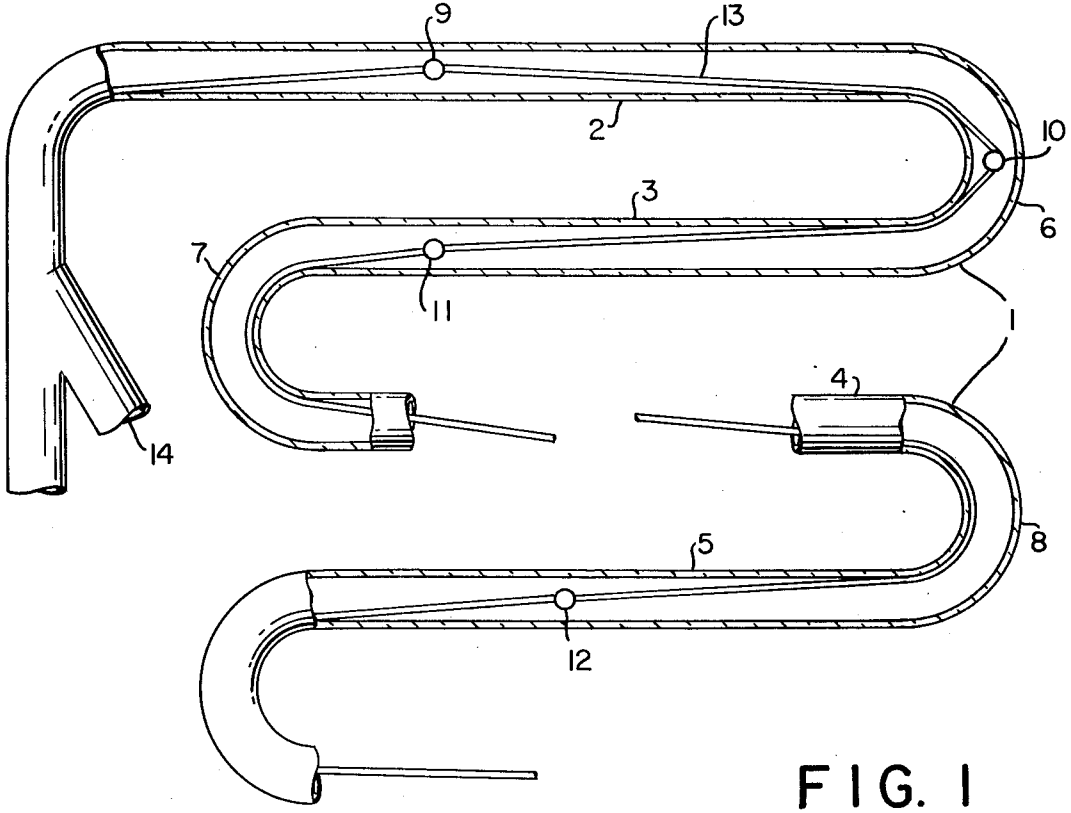
FIG. 1 is a schematic view illustrating the use of a multiplicity of flow diverters positioned on a transit line passing through a conduit having a series of straight sections and bends in an embodiment of the invention.

The objects of the invention are achieved by the discovery that the use of a multiplicity of propulsive bodies positioned at intervals along the length of a transit line enables the line to be conveniently passed through a conduit having a series of straight sections and bends. The multiplicity of such bodies serves to overcome the capstan effect that could otherwise result in such large frictional forces as to effectively impede the passage of the line along the straight sections and around the bends of the line from the inlet to the discharge end of the conduit. The propulsive bodies can readily be activated to move the transit line through the conduit by a number of convenient means as is hereinafter disclosed.

The invention has major significance in the decoking of furnace tubes, wherein furnace tube bundles having a series of straight sections and return bends may be encountered. As discussed in the background section above, it has not been possible heretofore to employ a flow diverter to facilitate the decoking and cleaning action of the Sandjet process in such an application. A free-flowing diverter is not suitable because it moves through the tubes too rapidly and may become jammed. The practical necessity for employing a tethered flow diverter, and the overwhelming frictional forces resulting from the capstan effect as a tether or connecting line is attempted to be passed through the furnace tube bundle, have thus served to preclude the passing of a flow diverter through the interior of furnace tubes having a typical series of straight sections and return bends. Surprisingly, this problem is overcome, in the practice of the invention, by passing more than one, and indeed a multiplicity of, flow diverters, i.e. propulsive bodies, through the conduit at intervals along the tether or connecting line serving as a transit line to be moved through the interior of the tubes. Rather than creating further potential for blockage and further frictional problems, the use of multiple flow diverters actually overcome the capstan effect that effectively precludes the passage of a single tethered flow diverter through the tubes.

As will be readily appreciated, the flow diverters are adapted to divert fluid injected into the inlet end of a conduit in the direction of the inside surface of the conduit. The flow diverters are activated by injecting pressurized fluid into the conduit through the inlet end thereof. The effect of the flow diverters is enhanced by providing diverters with a shape or configuration such that they are essentially centered within the inside diameter of the conduit through which they are being moved by the pressurized fluid. In furnace tube decoking applications, the pressurized fluid comprises a propelling gas stream injected into the conduit, said gas stream having entrained therein cleaning particles capable of decoking and cleaning, in-situ, the inside surfaces of the conduit. The conduit comprises fired heater tubes used in the hydrocarbon or chemical processing industries. Such tubes, including both the straight sections and the return bends, are decoked and cleaned with enhanced effectiveness as the tethered flow diverters pass therethrough, diverting the propelling gas stream, and the cleaning particles entrained therein, against the inside surfaces of the tubes for the enhanced cleaning thereof.

The flow diverters or other propulsive bodies secured to a transit line in the practice of the invention are intended to develop an aerodynamic drag or other force sufficient to move the transit line through the conduit. For this purpose, the propulsive force developed must exceed the combination of the frictional forces due to the capstan effect and the frictional forces due to the weight of the transit line itself. It has been found that the propulsive force developed is proportional to (1) the density of the propelling gas or other fluid, (2) the square of the average velocity of the fluid around the diverter or other propulsive bodies, (3) the cross-sectional area at the widest part of the propulsive bodies, and (4) the coefficient of drag for the particular shape of the propulsive bodies. The use of a multiplicity of flow diverters has been found to develop a propulsive force sufficient to overcome the combined frictional forces due to the capstan effect and to the weight of the transit line and to move the transit line at a controlled and predictable speed such as to enhance the effectiveness of the Sandjet process or of such other purpose as the transit line may be passed along the straight sections and around the bends of a conduit.

In the practice of the Sandjet process for the decoking and cleaning of furnace tubes, the descaling of heat exchanger tubes, pipeline cleaning and drying and the like, the propelling gas generally comprises nitrogen although air can be employed in some instances. Such gases or any other suitable gases can be employed as the pressurized fluid used to activate the flow diverters or other propulsive bodies employed to move the transit line through a tube bundle or other such conduit so long as the gases are compatible with the conditions in the conduit being cleaned. It is also within the scope of the invention to employ water or other liquid as the pressurized fluid used to move the transit line through a conduit, although the Sandjet process is generally carried out using a propelling gas stream as indicated above.

For the practice of the Sandjet process, the propelling gas stream is injected into the conduit to be treated at a gas flow rate corresponding to an outlet gas velocity of from about 5,000 feet per minute up to the sonic velocity of the propelling gas. Those skilled in the art will appreciate that the sonic velocity is the speed of sound in any particular propellant gas employed, and is the maximum velocity at which the gas can be passed through a pipeline. The sonic velocity of nitrogen is about 69,000 feet per minute, while that of air is about 68,000 feet per minute. The propelling gas stream, of course, has entrained therein cleaning particles capable of effectively cleaning, in-situ, the inside surfaces of the conduit. The flow of the particle-entrained gas stream is maintained for a sufficient time to effect cleaning of the conduit while said propelling gas stream causes the flow diverters, and the transit line, to move through the conduit. The outlet gas velocity of the propelling gas velocity will commonly be from about 7,000 to about 40,000 feet per minute. It will be appreciated that the outlet gas velocity employed in any given application will depend upon the various factors pertaining to the application, i.e. the nature of the conduit to be cleaned, the cleaning materials to be employed, the size and shape of the flow diverter, the particular propelling gas to be used, etc. It has been found, however, that in practical illustrative operations, the use of outlet gas velocities of up to about 20,000 feet per minute have been suitable for use with nitrogen as the propelling gas in furnace tube decoking applications in which various shaped flow diverters have been moved through straight section-return bend configurations on a transit line. Those skilled in the art will appreciate that the greater the outlet gas velocity, the greater will be the speed at which the transit line and the multiplicity of flow diverters will be moved through the conduit. The propelling gas velocity will thus be determined, for any given application, such that the effectiveness of the cleaning particles is enhanced by the flow diverters throughout the conduit without such slow movement of the diverters that undue erosion of the conduit itself occurs as a result of such slow movement of the diverters.

As noted above, the force tending to move the propulsive bodies, and the transit line, in the conduit will also depend on the cross-sectional area and the coefficient of drag of the flow diverters or other propulsive bodies employed. By increasing the cross-sectional area of the widest part of the propulsive body, a greater propulsive force will be achieved at least up to the point at which said cross-sectional area approaches the inside diameter of the conduit. An increase in the size of the base of a cone, for example, will increase the propulsive force of the cone used as a flow diverter. It will be appreciated, however, that if the cross-sectional area of the diverters becomes so large as to substantially seal the inside diameter of the conduit, the aerodynamic force tending to move the diverters will become diminished throughout the conduit, causing the capstan effect of the transit line to impede or prevent the desired movement of the flow diverters along the straight sections and around the bends of the conduit. The relative coefficient of drag for a particular shape can be determined by routine experimentation or by measurement based on the particular propulsive force achieved using a given propelling fluid, velocity of said fluid and cross-sectional area of the flow diverter and of the conduit. It has been found, for example, that a cup-shaped flow diverter may typically have a coefficient of drag twice that of a cone-shaped diverter.

It is within the scope of the invention to employ any desired shape of flow diverter or other propulsive body used to move a transit line through a conduit. If the movement of the transit line through the conduit is to enable flow diverters to enhance the cleaning action of the Sandjet process, it has been found that a cone-shaped diverter, positioned with its pointed end upstream, will deflect cleaning particles entrained in the propelling gas stream such that the angle of impact of the particles with the cone will substantially equal the angle of deflection of the particles. This will result in a mechanical effect in which the particles tend to impact the side of the conduit at a controlled angle of impact. As a result of controlled high angle impact, the cleaning particles remove the deposit by impact action rather than by a machining action. This may be advantageous in particular furnace tube decoking or other applications in which erosion of the conduit must be minimized. As was indicated in the Nunciato et al patent referred to above, impact cleaning with steel shot can be effectively utilized for the removal of coke from furnace tubes without the abrasive action that occurs in the machining-type cleaning achieved by the use of flint or grit. The effectiveness of the shot is limited, however, by the tendency of the shot to streamline down the center of the straight section of the tubes. Such a flow path limits the number of impacts of the shot with the side walls and the angle of impact, although minimizing erosion of the inside walls of the tubes. By the use of a cone having a 45° side angle, the cleaning particles can be caused to deflect toward the side walls at nearly a 90° angle. In this manner, the cleaning by impact of the particles with the side walls behind the downstream end of the diverter will be greatly enhanced. It will be appreciated, however, that for other applications, it may be desirable to employ a shape of the diverter such tnat an aerodynamic effect, rather than a mechanical effect, is achieved. A ball-shaped flow diverter can also be used conveniently and to advantage as is indicated in the discussion of the prior art.

As was noted above, the frictional forces due to the capstan effect have been found, heretofore, to effectively preclude the passage of a transit line through a furnace tube bundle or other conduit configuration having five or more series of straight sections and return bends. In this regard, it should be noted that the return bends of a furnace tube bundle are commonly 180° bends so that the conduit passes along a straight section in one direction, around the bend, and back in the opposite direction. The capstan effect is also operable, however, in other conduit applications in which the straight sections may be separated by 90° or other such bends although not of the repetitive 180° nature commonly occurring in furnace tube bundles. It is also within the scope of the invention to move a transit line through conduits having an equivalent continuous helical tube configuration. It is likewise within the scope of the invention to employ a multiplicity of propulsion bodies to facilitate passage of a transit line through bends such as entry and exit bends communicating with a main conduit section even if most or all of the main section itself is straight, or such as temporary bends used for conduit connection because of the particular geography of a given operation. For furnace tube or other applications it is common to encounter at least five and generally from about 10 to about 60 straight sections and return bends. In such applications and in those having a greater number of straight section return bend combinations, the invention facilitates the passage of a transit line therethrough, whereas the transit line would otherwise not be movable through such combinations of straight sections and return bends.

From the discussion above, it will be seen that each flow diverter or other propulsive body can be employed to supply a propulsive force that, in combination with each other of a multiplicity of such bodies, serves to overcome the combined frictional forces due to the capstan effect and to the weight of the transit line. It will also be appreciated by those skilled in the art that the number of flow diverters or other propulsive bodies needed for a given application will depend upon the variety of factors referred to above that pertain to that application. As used herein, tne term "multiplicity of propulsive bodies" means two or more such bodies with the total number being employed in a given application to a conduit having five or more bends being such as to enable the propulsive bodies to move within the conduit at a desired speed. In many applications, more than one propulsive body may be desirable for each straight section bend combination, with a range of from 1 to 4 propulsive bodies per bend being preferred in various embodiments of the invention. In other embodiments, less than one propulsive body per straight section-bend combination may be employed. The transit line should not, however, generally have to pass through five or more straight section-bend combinations with only one or no flow diverter or other propulsive body positioned in said portion of the conduit so as to avoid having the frictional force due to the capstan effect impede the passage of the transit line through the conduit. It will be appreciated by those skilled in the art that the number of flow diverters or other propulsive bodies positioned on the transit line will be determined, in practical commercial applications, by the requirements of the cleaning or the other operation for which tne passage of the transit line through the conduit is being employed.

Referring to the drawings, a typical positioning of a multiplicity of the flow diverters on a transit line passing through a conduit having straight sections and return bends is shown in FIG. 1. The numeral 1 represents a tube bundle having illustrated straight sections 2, 3, 4 and 5 and return bends 6, 7 and 8. The propulsive bodies are spherical or ball-shaped bodies 9, 10, 11 and 12 positioned along transit line 13. Means are provided for injecting a fluid into said tube bundle 1. It will be appreciated that said propulsive bodies act as flow diverters with respect to the injected fluid. In the practice of the Sandjet process, said fluid would have cleaning particles entrained therein, with the ball-shaped flow diverters causing transit line 13 to move through the tube bundle and causing the cleaning particles to divert toward the side walls of the conduits for enhanced cleaning effectiveness.

Figure 2:
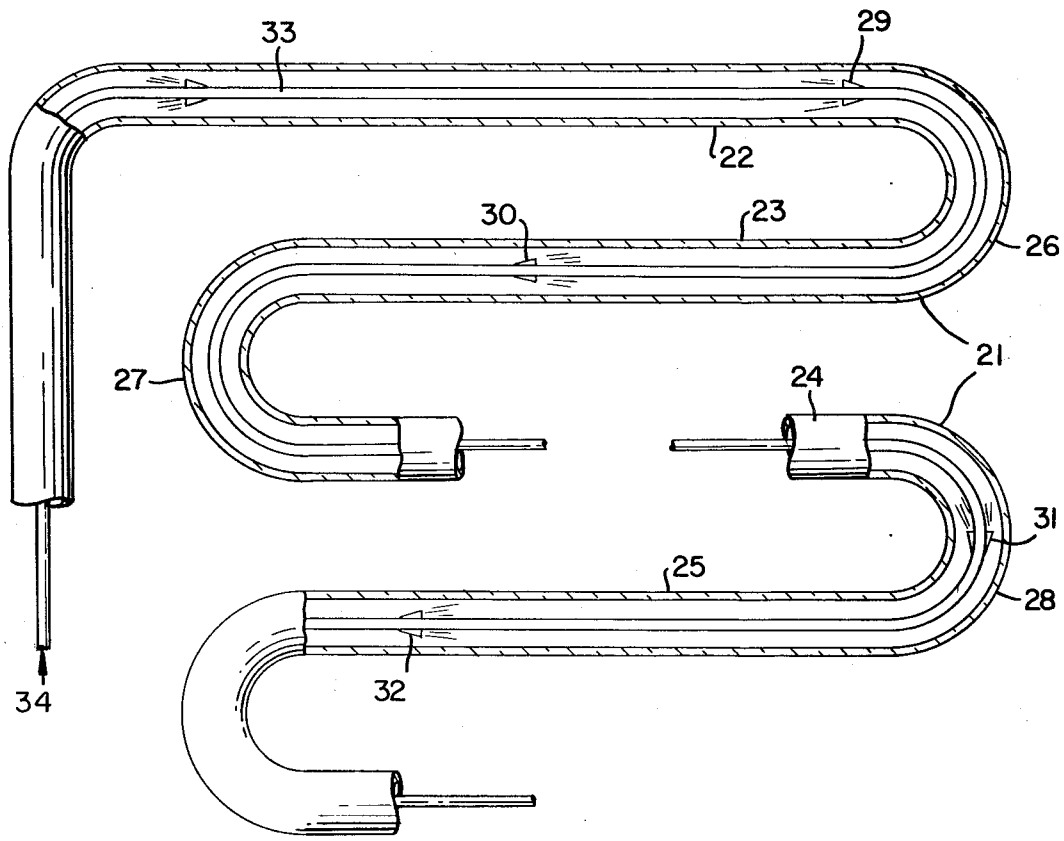
FIG. 2 is a schematic view illustrating the use of a multiplicity of propulsion jets attached to a hose to facilitate movement of the hose through such a conduit.

FIG. 2 illustrates a variation of the invention in which the propulsive bodies comprise propulsive jets positioned along the length of the transit line. In this embodiment, the numeral 21 represents a tube bundle having illustrated straight sections 22, 23, 24 and 25 and return bends 26, 27 and 28. The propulsive bodies comprising propulsive jets 29, 30, 31 and 32 are positioned along transit line 33, which comprises a hose suitable for the passage of a pressurized fluid therethrough. Means 34 are provided for injecting a pressurized fluid, e.g. a high pressure gas stream, into said hose 33 that acts as a tether for said propulsive jets. The propulsive jets will be provided with fluid exit apertures, not shown, positioned so as to cause fluid entering each said jet from the transit line hose to exit into the tubes themselves in a direction upstream i.e. toward the inlet end of the tube bundle, of said jets. It will be appreciated that this jet action upstream will cause a forward propulsive force in the downstream direction that serves to move the propulsive jets and the transit line along the straight sections and around the return bends of the tube bundle.

In the practice of the invention, the propulsive bodies can be positioned with equal spacing along the transit line or, alternatively, can be spaced unequally as may be desired for a given application or conduit combination. When the propulsive bodies are to be moved by a flow of pressurized fluid in the conduit, it is often desirable to space the bodies closer together at the front end of the transit line to facilitate initial movement of the line in the conduit. In this regard, it should be noted that the gas velocity at the inlet end of a conduit will be less than the outlet velocity from the conduit. The closer spacing of the propulsive bodies at the front end of the line thus compensates for the lower gas velocity of the propelling gas at the inlet end of the conduit. In the Sandjet process, such closer spacing of the flow diverters at the front end of the line, and more spaced apart positioning of the diverters at the back end of the line, serves also to limit the acceleration of the particle-entrained gas stream between diverters at the front end of the line and to increase the acceleration of said gas stream between diverters at the back end of the line. Operating in this manner, the enhanced cleaning action due to the more spaced apart diverters ensures the desired effectiveness of the overall operation without the possibility of excessive cleaning, and some undue erosion of the side walls of the conduit, due to an unnecessarily close spacing of the particles. In some instances, however, very close diverter spacing thoughout may be desirable to ensure the effectiveness of the cleaning of particularly difficult to remove deposits. In other instances, however, a wider spacing of the diverters along the entire transit line may be desirable. In practical embodiments of the invention, propulsive bodies have been positioned with various spacings, e.g. 10, 15, 20, 25 feet. Those skilled in the art will appreciate that the configuration of the tube bundle or other conduit in which the transit line is to be moved may effect the spacing employed in any particular embodiment. If the conduit has a very long straight section, for example, it may be possible to employ a wider spacing than if the conduit comprises a greater number of straight section-bend combinations.

It is within the scope of the invention to employ any suitable pressurized fluid to move tethered flow diverters through a conduit. Whereas nitrogen or air is commonly employed in Sandjet process operations as a high pressure gas stream capable of moving the diverters and the transit line through a tube bundle or other conduit, the pressurized fluid may comprise a commercially available gel or plasma flowed through the conduit as the motive force for causing said flow diverters or other propulsive bodies to be moved along the straight sections and around the bends of the conduit. Water or other convenient liquid can also be employed as the pressurized fluid in various embodiments of the invention.

The Sandjet process embodiments of the invention have been described above with respect to the use of steel shot, flint, grit or new cleaning agents as the particles entrained in the propelling gas stream that also serves as the pressurized fluid for moving the transit line and the flow diverters attached thereto through the conduit to be cleaned. It will be apparent that the invention is not dependent on the particular cleaning agent being used, as the use of a multiplicity of flow diverters will serve to enhance the cleaning effectiveness of any cleaning agent employed. Particularly effective decoking and other cleaning action has been heretofore achieved, however, by the use of cleaning particles having a regular non-random configuration with less than spherical symmetry. Cut wire, washers and slugs are examples of such materials which can be used advantageously in the practice of the invention as described and claimed herein.

In addition to the flow diverters and propulsive jets referred to above, any other convenient type of propulsive body can be used for the multiplicity of such bodies used to move a transit line through a conduit. For example, the propulsive bodies may comprise motor-operated bodies positioned along the length of the transit line. In this instance, the transit line may conveniently comprise an electrical cable adapted to activate the motors for movement of the propulsive bodies and the transit line through the conduit. For this purpose, for example, a reaction or contact motor may be positioned on a two or four wheeled carriage for convenient movement through the conduit.

The passage of a tethered multiplicity of flow diverters through a conduit having a series of straight sections and bends is but one of innumerable applications in which it may be desirable to pass a transit line through such a conduit. Thus, the transit line may be adapted to move an inspection or measurement means through the conduit. Such means may include camera, television or other such feedback devices. The transit line may also be adapted to move conduit cleaning or conditioning means through the conduit. Thus, the line may comprise a hose, cable or wire for a cleaning unit, such as a hydroblaster or sandblasting head, or a shot peening, scoring or similar surface conditioning unit. In addition, a transit line may be used to move a hydroblast or sandblast head through a pipeline or other conduit in which fluid flow in the conduit itself is used for the propulsive force and to maintain cleaning agent flow to said hydroblast or sandblast head.

The ability to move a transit line through a conduit having a series of straight sections and bends, without the overwhelming deterrent due to the capstan effect, likewise enables a heating or cooling element, or an optional fiber device or an ultrasonic cleaning or measurement device to be used, in-situ, in conduits heretofore unserviceable by such means. The transit line may, in another highly desirable embodiment of the invention be adopted to distribute inhibitor, catalyst, coating or chemical reagent materials into the conduit during its passage along the straight sections and around the return bends thereof. The ability to conveniently pass a welding or remotely operated mechanical hand assembly device, or a turbulence inducing or reaching device, through such a conduit, for the performance of in-situ functions therein, are further examples of the diversity and significance of the ability to conveniently pass a transit line through a conduit having a series of straight sections and bends.

Various changes or modifications can be made in the details of the process as herein disclosed without departing from the scope of the invention as hereinafter claimed. Thus, any shape of flow diverter may be employed and any convenient means for essentially centering the diverter or other propulsive body may be employed. It will be readily apparent to those skilled in the art that guide means can be molded, welded, cast, machined or otherwise secured to a flow diverter to facilitate its positioning essentially centered in the conduit through which it is being passed. While this is not an essential element of the invention, it will be seen that, for most applications, it will be desirable to have the diverters centered to the extent reasonably possible. It will also be appreciated that the flow diverters or other propulsive bodies, and the transit line, can be made of any suitable convenient material. High density polyurethane, steel, neoprene, and coated aluminum are representative examples of materials that may be employed. By making the propulsive bodies and the transit line of a heat or chemically sensitive material, removal of a unit that may become jammed in the conduit can be readily accomplished by heat or the dissolving action of solvents. The possibility of jamming of the bodies in the conduit can be diminished by practicing the invention such that the end portion of the transit line has no propulsive bodies positioned therein over a length extending from about one to three straight section-bend combinations. The drag generated as a result of the capstan effect due to this condition at the end of the line will serve to decrease or prevent any tendency of trailing propulsive bodies to overtake more leading bodies so as to cause an enlargement of the line and a jamming of the bodies in the conduit. In order to avoid jamming within the conduit, it should also be noted that the longest dimension of the flow diverter or other propulsive body should be less than the inside diameter of the conduit to facilitate passage of the body around the return bends of the conduit.

Upon exit from the conduit, the transit line may be conveniently rolled onto a reel for storage and re-use. The flow diverters or other propulsive bodies can be clipped or otherwise secured to the transit line as it is being moved to the conduit, and can be disengaged or removed therefrom, if desired, upon exit from the conduit for convenience of handling, storage and re-use. Such actions can be performed by hand or by suitable mechanical means, with an automated technique for securing and removing the propulsive bodies from the transit line being desirable to facilitate rapid and convenient carrying out of the overall operation. It is also within the scope of the invention, although generally less preferred, to leave the propulsive bodies on the transit line after exit from the conduit and to arrange the line, by hand or otherwise, in a convenient manner for handling, storage and re-use.

The invention has been carried out in a number of illustrative examples serving to demonstrate the benefits obtained thereby. Such examples should not be construed in any manner as limiting the scope of the invention as set forth in the appended claims. In one such example, a transit line was readily moved through a ½" I.D. tube, having 2' straight sections 22 return bends and a total length of 52', by the use of a multiplicity of flow diverters, whereas it was not otherwise possible to pass the transit line through said conduit. In this case, ¼" spheres were used as the flow diverters, and one diverter was used for every foot of said line. A nitrogen gas stream was injected into the inlet end of the conduit at an outlet gas velocity of about 1,500 feet per minute, and was found to readily move the transit line, and said flow diverters, along the straight sections and around the return bends of the conduit.

In another example, a number of ball-shaped propulsive bodies were attached to a 3" inside diameter (I.D.) conduit having a series of six straight section-return bend combinations, each straight section being 21' long. The balls were 2" in diameter, and a total of 18 balls were positioned on the transit line with spacings of from 10' to 25'. Nitrogen gas was injected into the conduit at about 10,000 feet per minute exit gas velocity. The pressurized gas stream was able to readily move the transit line and the flow diverters attached thereto in a controlled manner through the straight sections and around the return bends of the conduit from the inlet of the discharge end thereof. By contrast, it was attempted to move a single device through a similar 4" I.D. conduit having six return bends on a transit line using water as the pressurized fluid. The frictional force due to the capstan effect was so great that the device could not be moved through the conduit, and indeed the conduit configuration collapsed due to the force exerted on the line.

In still another example, a 4" I.D. tube was employed, said tube having a total loop length of 570' and a total of 22' return bends. Cone-shaped flow diverters were positioned on a transit line with an initial spacing of 5' to facilitate the initial movement of the line into the tubes. Spacing of subsequent diverters was up to about 15', and a total of 42 diverters were positioned on the line. The cones were positioned with their pointed ends upstream, i.e. in a direction facing the flow of propelling gas, the cone angle being 45° to the vertical. Each cone was 2½" in diameter at its widest part, i.e. the base, and had ¼" legs protruding therefrom at 90° angles to each other. While such a line could not be moved through the conduit in the absence of such a multiplicity of diverters, it was readily moved therethrough in a controlled fashion by the injection of pressurized nitrogen gas into the conduit at an outlet gas velocity of 8–9,000 feet per minute.

The first example will serve to illustrate that the outlet gas velocities set forth above with respect to the Sandjet process are not necessarily required in other applications in which a multiplicity of flow diverters are employed to move a transit line through a conduit. It is within the scope of the invention to employ pressurized gas streams at any velocity sufficient to achieve the desired movement through the conduit. It will be appreciated that the gas velocity will depend on a number of factors, as discussed above, including the number of diverters employed, the size and shape of the diverters, etc. In general, however, the outlet gas velocity will be at least about 500 feet per minute, the higher range of velocities employed in the Sandjet process being chosen to enhance the effectiveness of the cleaning action of the particles entrained in the gas stream. In some instances, it may be desirable to employ outlet gas velocities of less than about 5,000 feet per minute in the Sandjet process in the event the use of a multiplicity of flow diverters is found to enhance the effectiveness of the cleaning action at such relatively low velocities.

While the invention has been described above with reference to conduits having straight sections and bends, it should be noted that a multiplicity of propulsive bodies can also be used to move a transit line through a very long section of straight pipe or other such conduit. A pipeline or other straight conduit may not be subject to the capstan effect but may nevertheless be such that it is impossible or impractical to pass a transit line through. It may, nevertheless, be highly desirable to be able to pass a line through such a long conduit for any of the variety of useful purposes referred to above. In such cases, the frictional force of the transit line can be overcome and the line can be conveniently moved therethrough the positioning of a multiplicity of flow diverters or other propulsive bodies therein. The number and positioning of such diverters, of any desired shape, would be determined by the amount of propulsive force required, the speed with which the line is to be moved and the like. The spacing of the propulsive bodies might be similar to that employed in the applications referred to above, or might be greater because of the absence of the capstan effect over the length of the conduit. As noted above, however, entry and exit lines, or temporary connections, may contain bend portions so as to introduce the capstan effect even though the major portion of the conduit contains no bends. In such cases, the number, spacing and size of the diverters or other propulsive bodies would be adjusted to overcome both the frictional force due to the capstan effect and the frictional force due to the weight of the line itself.

The invention will be seen to represent a major advance in the art. This advance relates not only to the in-situ Sandjet process, but to the ability to perform an endless variety of functions in-situ in a manner not heretofore possible because of the inability to pass a transit line through a conduit. In the practice of the Sandjet process, the ability to utilize flow diverters to enhance the cleaning action of entrained particles enables this highly desirable process to be carried out with even greater effectiveness and reliability. The extension of the process to the in-situ cleaning of difficult-to-remove deposits not heretofore susceptible to such treatment will enable the Sandjet process to be extended to an even wider segment of the processing industries dependent upon rapid, effective, reliable cleaning techniques and services. By the use of multiple flow diverters in accordance with the invention, the Sandjet process will be able to satisfy such needs in the cost effective, time saving manner in which it now serves in a variety of furnace tube decoking and cleaning, pipeline cleaning and drying and related in-situ treatment operations.

I claim:

1. An improved process for the cleaning of the interior of a conduit having a series of straight sections and bends comprising:

(a) passing a transit line to the inlet end of said conduit for passage therethrough, said line having a multiplicity of flow diverters positioned at intervals along the length thereof such that at least more than one such flow diverter is employed for five straight section-bend combinations, said conduit having at least five such combinations, said flow diverters being adapted for activation as propulsive bodies soley by the injection of a propelling gas stream into the conduit itself through the inlet end thereof, no other propulsive bodies or means of propulsion being positioned along the length of said transit line;

(b) activating said flow diverters within said conduit solely by injecting of a propelling gas stream into the conduit through the inlet end thereof, said flow diverters being adapted for diverting said gas in the direction of the inside surfaces of said conduit to be cleaned, said propelling gas stream being injected into the conduit at a gas flow rate corresponding to an outlet gas velocity of from about 5,000 feet per minute up to the sonic velocity of the propelling gas stream, which has entrained therein cleaning particles capable of the in-situ cleaning of the inside surfaces of the conduit, said injection of the particle entrained, propelling gas stream being maintained for a sufficient time to effect cleaning of the conduit while the propelling gas stream causes the flow diverters and the transit line to move along the straight sections and around the bends of said conduit, whereby said multiplicity of flow diverters serves to enhance the in-situ cleaning action of said cleaning particles and to overcome the capstan effect that otherwise impedes the passage of the transport line through said conduit having at least five straight section-bend combinations, thereby facilitating the convenient passage of said line along said straight sections and around the bends from the inlet to the discharge end of the conduit to facilitate the in-situ cleaning thereof.

2. The process of claim 1 in which said flow diverters are essentially centered within the conduit through which they are being moved.

3. The process of claim 1 in which said flow diverters are ball-shaped.

4. The process of claim 1 in which said flow diverters are cone-shaped.

5. The process of claim 1 in which said outlet gas velocity is from about 7,000 to about 40,000 feet per minute.

6. The process of claim 1 in which the concentration of cleaning particles introduced into the conduit is from about 0.1 to about 10 pounds of particles per pound of propelling gas.

7. The process of claim 6 in which said particle concentration is from about 0.1 to about 1.0 pounds of particles per pound of propelling gas.

8. The process of claim 1 in which said propelling gas comprises nitrogen.

9. The process of claim 1 in which said conduit comprises fired heater tubes used in hydrocarbon or chemical processing, said tubes being decoked as the flow diverters pass through said conduit, diverting said propelling gas stream, and the cleaning particles entrained therein, against the inside surfaces of the conduit for the enhanced cleaning thereof.

10. The process of claim 9 in which said cleaning particles comprise steel shot.

11. The process of claim 9 in which said cleaning particles have a regular, non-random configuration with less than spherical symmetry.

12. The process of claim 9 in which at least one such flow diverter employed for each straight section-return bend combination in said conduit.

13. The process of claim 12 in which each said straight section-return bend combination being cleaned has at least one flow diverter positioned on the transit line passing through said straight section-return bend combination.

14. The process of claim 1 in which said multiplicity of flow diverters comprise from about 1 to about 4 such diverters for each return bend contained in the conduit through which the transit line is being passed.

15. The process of claim 14 in which said flow diverters are positioned at approximately the same intervals along said transit line.

16. The process of claim 14 in which said flow diverters are positioned at unequal intervals along said transit line.

17. The process of claim 16 in which the flow diverters are positioned more closely together at the front end of said transit line and with greater spacing therebetween at the back end of said line.

18. The process of claim 9 in which said conduit contains from about 10 to about 60 return bends.

19. The process of claim 18 in which from about one to about four flow diverters are employed for each straight section-return bend combination.

20. The process of claim 18 in which less than one flow diverter is employed for each straight section-return bend combination, the number of said flow diverters and the spacing thereof being such that there is at least more than one flow diverter positioned in each five straight section-return bend combinations in which said transit line is positioned.

21. The process of claim 18 in which the end portion of the transit line extending from about one to about three straight section-return bend combinations in length has no flow diverters positioned thereon.

22. The process of claim 1 in which said flow diverters are spaced more closely together at the front end of the transit line than at the back end of said line.

23. The process of claim 22 in which said conduit contains from about 10 to about 60 return bends.

24. The process of claim 23 in which from about one to about four flow diverters are employed for each return bend.

* * * * *